US006786011B2

(12) United States Patent
Mares

(10) Patent No.: US 6,786,011 B2
(45) Date of Patent: Sep. 7, 2004

(54) METHOD OF SEALING A SLOPED ROOF TRANSITION ELIMINATING ATTACHING COUNTER FLASHING TO A MASONRY WALL

(76) Inventor: Manuel Mares, 8369 N. Highway 75, Anna, TX (US) 75409

( * ) Notice: Subject to any disclaimer, the term of this patent is extended or adjusted under 35 U.S.C. 154(b) by 160 days.

(21) Appl. No.: 10/299,608

(22) Filed: Nov. 20, 2002

(65) Prior Publication Data

US 2004/0093806 A1 May 20, 2004

(51) Int. Cl.[7] ..... E04D 1/36; E04D 3/30; E04D 13/14

(52) U.S. Cl. ..... 52/62; 52/60; 52/302.6; 52/741.1; 52/741.4; 52/58

(58) Field of Search ..... 52/62, 741.1, 58, 52/59, 60, 61, 302.3, 302.6, 169.5

(56) References Cited

U.S. PATENT DOCUMENTS

| | | | | | |
|---|---|---|---|---|---|
| 1,231,711 | A | | 7/1917 | Cordes | |
| 1,377,349 | A | * | 5/1921 | Holder | 52/62 |
| 1,666,231 | A | | 4/1928 | Loxham | |
| 1,685,525 | A | | 9/1928 | Dow | |
| 1,699,181 | A | * | 1/1929 | Davison | 52/60 |
| 1,750,526 | A | | 3/1930 | Knox | |
| RE17,818 | E | * | 9/1930 | Young | 52/61 |
| 2,974,448 | A | * | 3/1961 | Weis | 52/60 |
| 2,996,843 | A | | 8/1961 | Macf | |
| 3,608,255 | A | | 9/1971 | Chomes | |
| 3,698,142 | A | | 10/1972 | Theribult | |
| 3,719,010 | A | * | 3/1973 | Hickman | 52/60 |
| 4,485,600 | A | * | 12/1984 | Olson | 52/62 |
| 4,951,431 | A | | 8/1990 | Sweers | |
| 5,077,943 | A | | 1/1992 | McGady | |
| 5,109,641 | A | | 5/1992 | Halan | |
| 5,263,287 | A | | 11/1993 | Lyons, Jr. | |
| 6,167,660 | B1 | | 1/2001 | Sama | |
| 6,298,609 | B1 | | 10/2001 | Bifano | |

FOREIGN PATENT DOCUMENTS

| | | | | | |
|---|---|---|---|---|---|
| JP | 05112989 | A | * | 5/1993 | E04B/1/64 |

* cited by examiner

*Primary Examiner*—Anthony D. Barfield
(74) *Attorney, Agent, or Firm*—Patrick J. Glynn

(57) ABSTRACT

A method of using flashing having a counter flashing member and preferably fabricated from one piece of material is described for weather proofing the juncture of a building at the edge of a sloped roof covered with shingles and a vertical wall covered with a masonry veneer. The flashing is positioned above the surface of the roof by resting it on a fabricated support positioned at the juncture so that the counter flashing member is extending downward to the roof surface overlapping the vertical flashing member of a shingle-based flashing, such as, step flashing protruding from and above the surface of the roof and flush with the support. Construction of the masonry veneer is begun atop the support with a section of the flashing being interposed between the bottom of the masonry wall and the fabricated support after the flashing, including its counter flashing member, has been properly positioned to cover the support and the vertical flashing member protruding from above the surface of the roof, thereby eliminating the need for separately attaching a piece of counter flashing to the masonry veneer after it has been constructed to overlap the protruding vertical flashing member.

14 Claims, 3 Drawing Sheets

Fig. 1
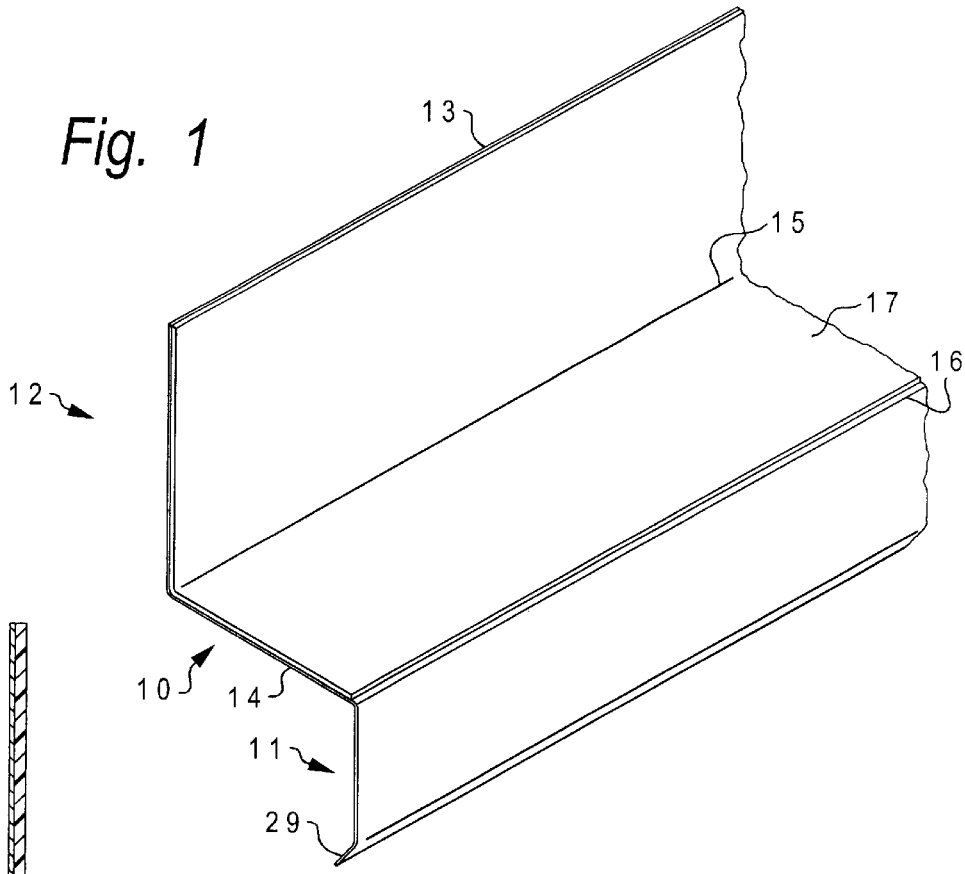
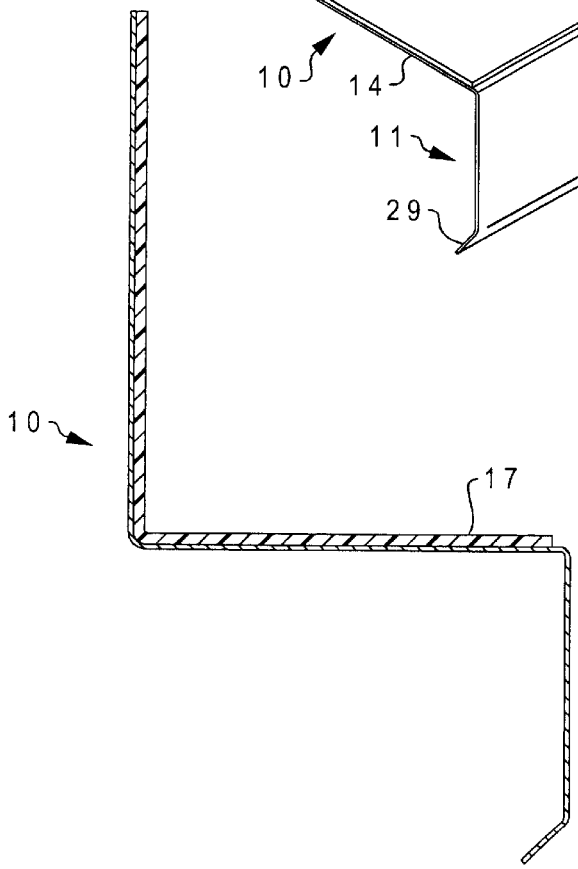
Fig. 2

METHOD OF SEALING A SLOPED ROOF TRANSITION ELIMINATING ATTACHING COUNTER FLASHING TO A MASONRY WALL

BACKGROUND OF THE INVENTION

The present invention relates to a novel method of weather proofing the roof transition from a sloped roof to a vertical wall in the construction of buildings. A gable, for example, has two vertical framed walls expanding from the surface of a sloped roof forming a sloping juncture between the each vertical wall of the gable and its corresponding edge of the sloped roof. It is imperative to seal this juncture from moisture that can penetrate the framework of the building, resulting in the accumulation of moisture contributing to mold growth and decay of the framework. The use of roof transition flashing is therefore required.

More specifically, the present invention relates to so-called brick on wood applications where the vertical framed wall is covered with a masonry wall, such as, brick and mortar. According to conventional methods, construction of the masonry wall begins at the level of the sloped roof and continues upward until the underlying vertical wall, usually comprised of wood, is completely covered. Typically, a shingle-based flashing, such as, separate sections of L-shaped step flashing is employed, each having a vertical and horizontal member. The horizontal member is sandwiched between overlapping roof shingles that abut against the bottom of the masonry wall that has been constructed from the roof deck, while the vertical or bent-up leaf member protrudes from and above the roof surface and is flush against the bottom of the masonry wall. The seam formed by the ninety degree bend of step flashing will cover the juncture of the roof deck and the bottom of the masonry wall, however, the bent up leaf member is exposed and unsightly, and must be overlapped by counter flashing extending in the opposite direction. It is necessary, therefore, to attach the counter flashing to the masonry wall for proper positioning to extend downward and cover any exposed flashing rising from the surface of the roof; in this case the bent-up leaf member of the step flashing. However, attaching counter flashing to the masonry wall is undesirable, especially when the masonry wall is constructed from brick and mortar. First, this procedure usually requires gouging through disparate densities of the brick and mortar after construction of the masonry wall in order to insert a separate piece of counter flashing therein. This is because the gouge is made parallel to the slope of the roof, but the bricks are laid horizontally and parallel to the ground making it impractical to anchor the counter flashing entirely within a mortar joint between adjacent layers of bricks in the middle of constructing the masonry wall, as in the case of flat roof transitions shown in the prior art. Secondly, this procedure extends the time for completing installation of the flashing, the construction of the masonry wall falling between initial installation of the shingle-based step flashing and completion of the job by attaching the counter flashing to the masonry wall after its construction. As a result, there is added cost of fabricating and attaching a separate piece counter flashing at a later date.

SUMMARY OF THE INVENTION

The improved method according to the invention is less expensive and time consuming, eliminating the need for separately fabricating and attaching counter flashing to the masonry wall after its construction, such as, by gouging, embedding or tacking. This is accomplished by positioning flashing having a counter flashing member entirely above the surface of the sloped roof by placing it atop a fabricated flashing support, resting on the roof deck at the sloping juncture, and constructing the masonry wall on the support so that a section of the flashing is interposed between the top of the support and the bottom of the masonry wall. Because the entire flashing is elevated above the surface of the roof by the height of the support, the counter flashing member is in a proper position for downward extention to overlap any unsightly and exposed shingle-based flashing member, such as, step flashing that protrudes from and above the surface of the roof. Therefore, the installation of all flashing is entirely complete before the masonry construction is begun. Accordingly, when the flashing is in proper position on the support, the masonry wall can be constructed from an elevated position on the fabricated support above the surface of the roof, including a wall cavity formed between the underlying vertical wall of the building and the interior surface of the masonry wall. Because a section of the flashing is resting directly on the support, it forms the bottom of the wall cavity and replicates the slop of the roof; thus providing a means for channeling water away from the building that has seeped through the masonry wall and flowed downward behind the masonry wall to the section of the flashing resting directly on the support.

Therefore, the object of the invention is to provide an improved method of placing flashing and counter flashing for sealing a sloped roof and masonry wall transition obviating the need for attaching a separate counter flashing to the masonry wall for overlapping any shingle-based flashing protruding form and above the surface of the roof.

A further object of the invention is to provide a means of channeling water that has seeped through the masonry wall downward with respect to the sloping roof.

BRIEF DESCRIPTION OF THE DRAWINGS

FIG. 1 is a perspective view of the preferred flashing employed according to the invention.

FIG. 2 is a cross-sectional view of the preferred flashing illustrating the L-shaped member coated with a polymeric material.

DETAILED DESCRIPTION OF THE PREFERRED EMBODIMENT OF THE INVENTION

Figure 3:
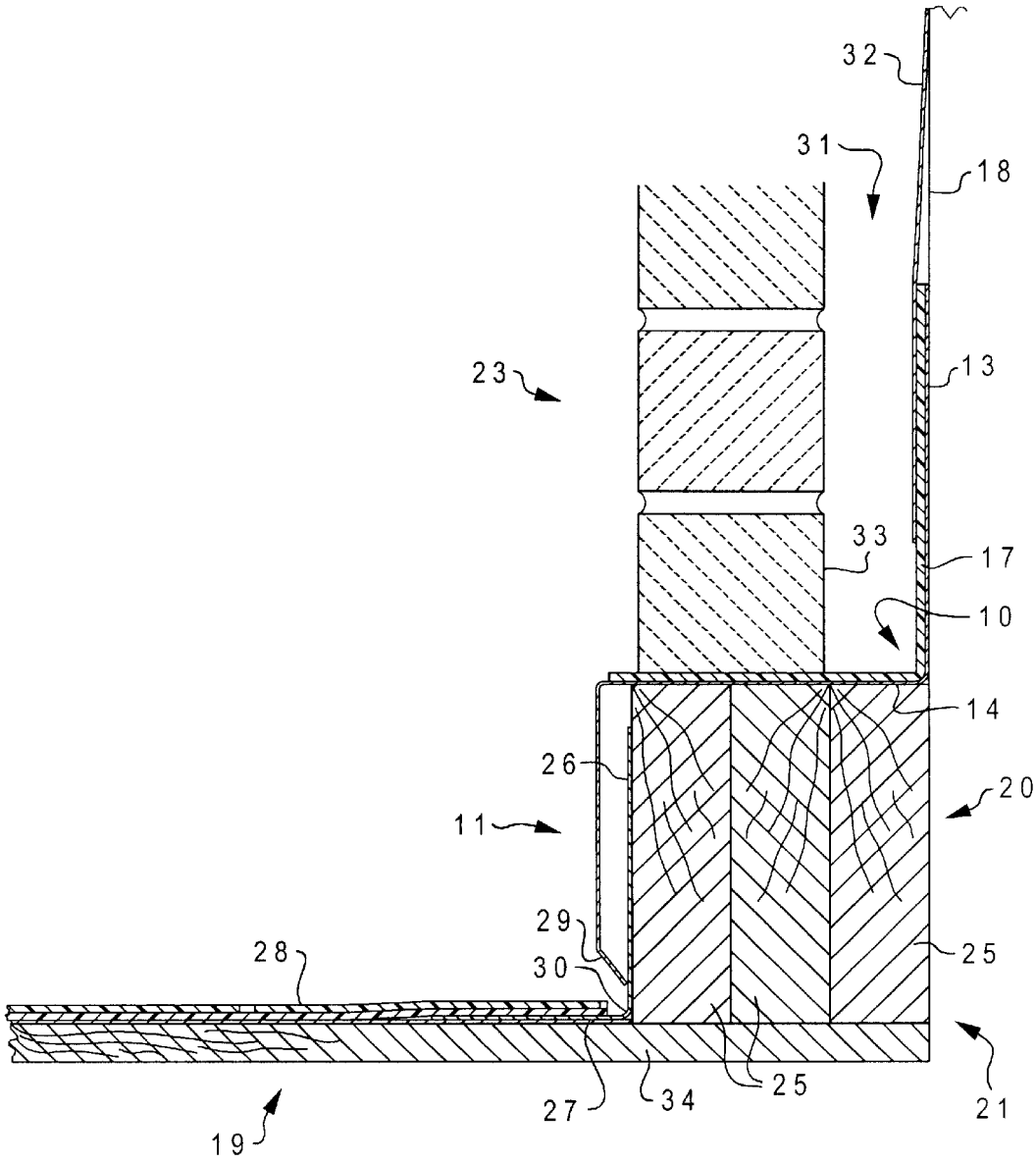
FIG. 3 is a cross-sectional view illustrating the method of weather proofing the roof transition according to the present invention.

Although any flashing adapted or fabricated according to the method of the present invention can be used, flashing made from one piece of material adapted for resting atop the support with a downward extending counter flashing member is preferred. FIG. 1 illustrates the preferred one-piece flashing comprising an L-shaped member 10 and a counter flashing member 11 forming the one-piece flashing 12. As shown, there is the L-shaped member 10 having a vertical planar section 13 joined to a transverse planar section 14 by a first imperforate seam 15. The counter flashing member 11 extends downward from the transverse planar section 14 and is joined thereto by a second imperforate seam 16. The flashing is preferably fabricated from sheet metal that is bent forming the imperforate seams. The vertical planar section 13 and transverse planar section 14 of the L-shaped member 10 are preferably coated with a polymeric material 17 prior to installation, as shown in FIGS. 1 and 2, to guard against corrosion and mold growth.

Figure 4:
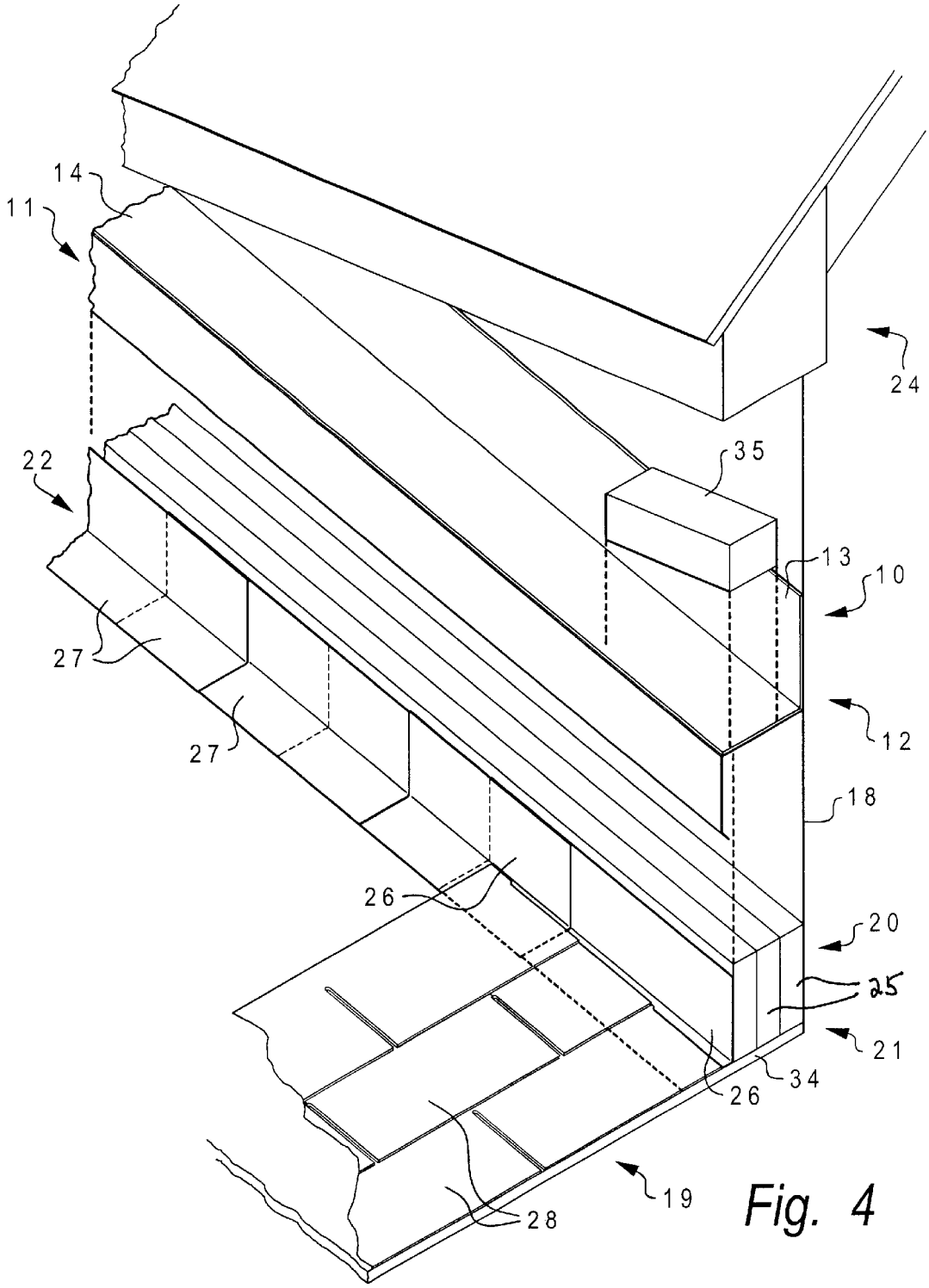
FIG. 4 is a perspective view and a schematic illustrating the method of weather proofing a roof transition according to the present invention.

FIG. 4 is a schematic illustrating the improved method of weather proofing the sloping juncture 21 of the vertical framed wall 18 and sloped roof 19. The flashing support 20 is placed on the roof deck 34 at the sloping juncture 21 and extends the length of the sloping juncture 21. Because the flashing support 20 is resting entirely on the roof deck 34, it is parallel to the slop of the roof 19. As shown in FIG. 4, separate pieces of step-flashing 22 are employed, each comprising a transverse planar section 27 joined to a bent-up leaf member 26. The bent-up leaf member 26 extends vertically above the shingles 28, bearing against the support 20. Because the bent-up leaf member 26 is exposed and unsightly, it must be covered by the counter flashing member 11 according to the invention. The transverse planar section 27 is sandwiched between the overlapping layers of shingles 28 for diverting rain water away from the roof structure that managed to seep between the shingles 28. The one-piece flashing 12 is positioned upon the flashing support 20, and the masonry wall 23, preferably made of brick 35, is constructed on top of the transverse planar section 14 above the surface of the roof 19.

As illustrated in FIG. 3, the support 20 is preferably formed from a plurality of wood planks 25 resting on edge so that planar surfaces are facing one another, although light-weight material other than wood in any configuration can be used, such as, aluminum and plastic so long as the material can function as a flashing support according to the invention. The number of planks 25 used and the spacing between the planks 25 can be adjusted for optimum placement of the support 20 to insure that the support 20 is flush against the bent-up leaf members 26 of the step flashing 22 and flush against the vertical framed wall 18. Thin pieces of flat wood, for example, can be used between the planks 25, if necessary, as spacers. The purpose of the support 20 is twofold. First, it elevates the one-piece flashing 12 above the roof surface so that the counter flashing member 11 is in position to extend downward for overlapping the bent-up leaf members 26, again, eliminating the need for attaching a counter flashing to the masonry wall 23 after it has been constructed. Secondly, it provides support for the masonry wall 23 and the one-piece flashing 12.

As illustrated in FIG. 3, when the transverse planar section 14 is resting atop the support 20 and sandwiched between the support 20 and the masonry wall 23, the vertical planar section 13 is positioned behind the masonry wall 23 and flush against the underlying vertical framed wall 18. Therefore, the only flashing exposed to the outside is the counter flashing member 11 which is extending downward from the transverse planar section 14, overlapping the exposed and unsightly bent-up leaf member 26, completing the sealing of the juncture 21.

As mentioned, the masonry wall 23 is preferably constructed of brick and mortar forming a brick veneer over the underlying vertical framed wall 18 of the building 24. The bricks are laid horizontally and therefore at an angle to the slop of the roof as illustrated by the alinement of brick 35 in FIG. 4. Optionally, the outer surface of the underlying vertical wall 18 may be covered with protective sheathing 32 overlapping the vertical planar section 13, illustrated in FIG. 3, prior to constructing the masonry wall 23. According to the preferred embodiment of the invention, the masonry wall 23 is built-up so that it is partially contained within the L-shaped member 10. Thereby, unlike conventional construction methods, the masonry wall 23 rather starts from above the surface of the roof than directly upon the roof deck 34. As illustrated in FIG. 3, construction of the masonry wall 23 should include a wall cavity 31 behind the masonry wall 23 for water drainage and evaporating air flow between the vertical framed wall 18 and the masonry wall 23. Rainwater normally flowing down the outer surface of the masonry wall 23 will seep through the masonry wall 23 and flow downward inside the wall cavity 31 to the transverse planar section 14. The portion of the wall cavity formed by the vertical planar section 13 and the opposing interior surface of the masonry wall 33, forms a channel directing the seeping water downward according to the slope of the roof and away from the building 24. As already mentioned, it is preferable to coat the L-shaped member 10 with a mold and corrosive resistant material 17, such as, a rubber-based material known as "Carsile", prior to installation illustrated in FIGS. 2 and 3. Furthermore, if necessary to secure the one-piece flashing 12 in position by tacking the vertical planar section 13 flush against the vertical framed wall 18 prior to construction of the masonry veneer, the rubber-based coating makes the vertical planar section 13 self-sealing against moisture penetration where it has been punctured.

The counter flashing member 11 has an indented lip 29 for optimum sealing. The lip 29 is formed at the bottom edge of the counter flashing member 11 and preferably engages the imperforate seam 30 of the step flashing 22, shown in FIG. 3, to enhance the water diverting and sealing properties of the counter flashing member 11.

After installing all flashing and constructing the masonry wall 23, only the counter flashing member 11 is visible below the masonry wall as though underscoring the masonry wall 23; therefore, it is preferable to paint or place ornamental designs on the outer surface counter flashing member 11 to enhance the appearance of the building 24.

I claim:

1. An improved method of using flashing for weather proofing a building at the juncture of the edge of a sloped roof and a vertical wall, wherein the sloped deck of the roof is covered with shingles combined with a shingle-based flashing having a bent-up leaf member protruding above the roof surface for sealing the juncture, and the vertical framed wall is covered by a masonry wall and counter flashing is used to overlap the bent-up leaf member of the shingle-based flashing to complete the sealing of the juncture, the improvement comprising the steps of:

(a) positioning a fabricated support on the roof deck at the juncture so that the support extends the length of the juncture and parallel to the slope of the roof and is flush with the bent-up leaf member and the vertical framed wall of the building;

(b) covering the fabricated support with a flashing having a counter flashing member so that the flashing is resting on the support entirely above the surface of the sloped roof and the counter flashing member is extending downward adjacent to the support overlapping the bent-up leaf member; and (c) beginning construction of the masonry wall above the surface of the roof upon the fabricated support so that a section of the flashing is interposed between the fabricated support and the bottom of the masonry wall;

whereby the need for separately attaching counter flashing to the masonry wall for overlapping the bent-up leaf member is eliminated.

2. The improved method of claim 1 wherein the fabricated support is made of light-weight material.

3. The improved method of claim 2 wherein the fabricated support comprises a plurality of wood planks resting on edge with their planar surfaces facing one another.

4. The improved method of claim 3 wherein spacing means is employed between the planar surfaces of the planks so that the fabricated support is flush with the vertical framed wall of the building and the bent-up leaf member of the shingle-based flashing.

5. The improved method of claim 1 wherein the flashing is coated with a polymeric material except the counter flashing member.

6. The improved method of claim 1 wherein the masonry wall is constructed so that a cavity is formed behind the masonry wall for channeling water that seeped through the masonry wall downward with respect to the sloping roof.

7. The method of claim 1 wherein the counter flashing member has a lip indented inward at its lowest downward extension for sealingly engaging the bent-up leaf member of the shingle-based flashing.

8. An improved method of using flashing for weather proofing a building at the juncture of the edge of a sloped roof and a vertical wall, wherein the sloped deck of the roof is covered with shingles combined with a shingle-based flashing having a bent-up leaf member protruding above the roof surface for sealing the juncture, and the vertical framed wall is covered by a masonry wall and counter flashing is used to cover the bent-up leaf member of the shingle-based flashing to complete the sealing of the juncture, the improvement comprising the steps of:

(a) positioning a fabricated support at the juncture so that the support extends the length of the juncture and parallel to the slope of the roof and is flush with the bent-up leaf member of the shingle-based flashing and the vertical framed wall of the building;

(b) covering the fabricated support with a one-piece flashing so that the one-piece flashing is positioned entirely above the surface of the roof, the one-piece flashing being shaped like a step having an L-shaped member with a vertical planner section and a transverse planar section joined thereto by a first imperforate seam and extending laterally therefrom, and a counter-flashing member extending downwardly and generally perpendicularly from the transverse planar section and joined thereto by a second imperforate seam, so that the transverse planar section is securely resting atop the fabricated support and the vertical planar section is flush against the surface of the vertical framed wall, and the counter flashing member is extending downward adjacent to the support overlapping the bent-up leaf member of the shingle-based flashing; and (c) constructing the masonry wall beginning above the roof surface so that the transverse planar section of the L-shaped member is interposed between the fabricated support and the bottom of the masonry wall;

whereby the need for separately attaching counter flashing to the masonry wall for overlapping the bent-up leaf member is eliminated.

9. The improved method of claim 8 wherein the fabricated support is made of light-weight material.

10. The improved method of claim 9 wherein the fabricated support comprises a plurality of wood planks resting on edge with their planar surfaces facing one another.

11. The improved method of claim 10 wherein spacing means is employed between the planar surfaces of the planks so that the fabricated support is flush with the vertical framed wall of the building and the bent-up leaf member of the shingle-based flashing.

12. The improved method of claim 8 wherein the L-shaped member is coated with a polymeric material prior to installation.

13. The improved method of claim 8 wherein the masonry wall is constructed so that a cavity is formed behind the masonry wall for channeling water that seeped through the masonry wall downward with respect to the sloping roof.

14. The method of claim 8 wherein the counter-flashing member has a lip indented inward at its lowest downward extension for sealingly engaging the bent-up leaf members of the shingle-based flashing.

* * * * *